US005886458A

United States Patent [19]

Chen Hsu

[11] Patent Number: 5,886,458

[45] Date of Patent: Mar. 23, 1999

[54] LAMP BULB WITH TWO FILAMENTS FOR CHRISTMAS TREE LIGHT

[76] Inventor: Hsueh-Hung Chen Hsu, No. 1, Lane 68, Hsiang Yuan St., Hsin Chu City, Taiwan

[21] Appl. No.: 858,401

[22] Filed: May 19, 1997

[51] Int. Cl.[6] ..... H01J 1/02

[52] U.S. Cl. ..... 313/25; 313/243; 313/316; 313/443

[58] Field of Search ..... 313/25, 493, 634, 313/243, 316

[56] References Cited

U.S. PATENT DOCUMENTS

| | | | |
|---|---|---|---|
| 3,330,984 | 7/1967 | Smith | 313/316 |
| 4,179,637 | 12/1979 | Santora | 313/316 |
| 5,384,510 | 1/1995 | Arnold | 313/316 |

*Primary Examiner*—Vip Patel
*Attorney, Agent, or Firm*—Rosenburg, Klein & Bilker

[57] ABSTRACT

A lamp bulb for a Christmas tree light set including two filaments connected between two lead-in wires thereof at different elevations above a mica disc.

1 Claim, 5 Drawing Sheets

LAMP BULB WITH TWO FILAMENTS FOR CHRISTMAS TREE LIGHT

BACKGROUND OF THE INVENTION

The present invention relates to lamp bulbs for a Christmas tree light set, and relates more particularly to such a lamp bulb which has two filaments connected between two lead wires thereof at different elevations.

A regular lamp bulb 10' for Christmas tree light, as shown in FIGS. 1 and 2, comprises a mother bulb 26', a daughter bulb 27' inside the mother bulb, a first lead-in wire 21', a second lead-in wire 22', a mica disc 25' fastened to the first lead-in wire 21' and the second lead-in wire 22' inside the daughter bulb 27', an exhaust bead 20' fastened to the first lead-in wire 21' and the second lead-in wire 22' inside the daughter bulb 27' and below the mica disc 25', and a filament 23' connected between the alloy tip of the first lead-in wire 21' and the magnesium-coated tip of the second lead-in wire 22' inside the daughter bulb 27' and spaced from the mica plate 25' at one side opposite to the exhaust bead 20'. Because this structure of lamp bulb has only one filament disposed inside the daughter bulb, it is less brightness when turned on.

SUMMARY OF THE INVENTION

The present invention provides a lamp bulb for a Christmas tree light set which produces a high intensity of light when turned on. According to the present invention, the lamp bulb has a mother bulb and a daughter bulb inside the mother bulb, two filaments connected between two lead-in wires thereof at different elevations above a mica disc. The filaments can be disposed both in the daughter bulb of the lamp bulb, or with one in the daughter bulb and the other in the mother bulb.

DETAILED DESCRIPTION OF THE PREFERRED EMBODIMENT

Figure 1:
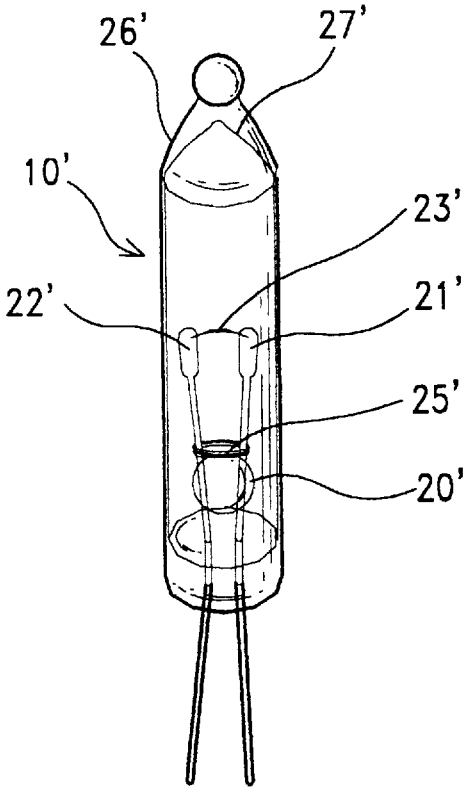
(PRIOR ART) FIG. 1
FIG. 1 is a perspective elevational view of a lamp bulb for Christmas tree light according to the prior art.
Figure 2:
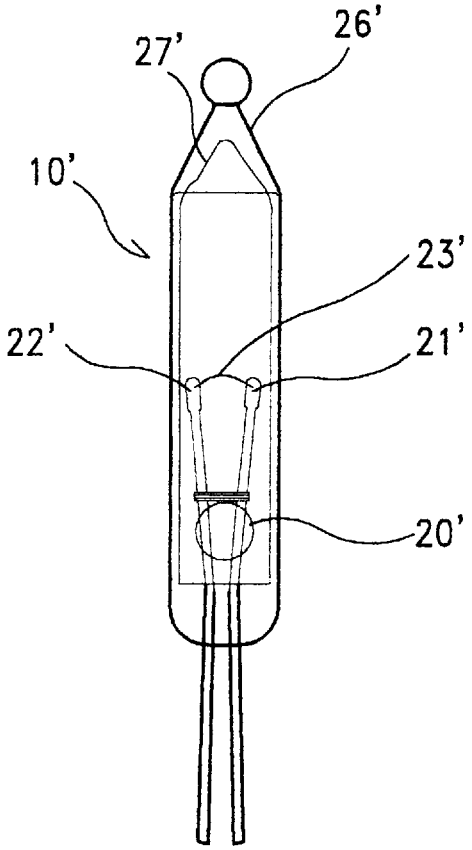
(PRIOR ART) FIG. 2
FIG. 2 is a plain view of the lamp bulb shown in FIG. 1.
Figure 3:
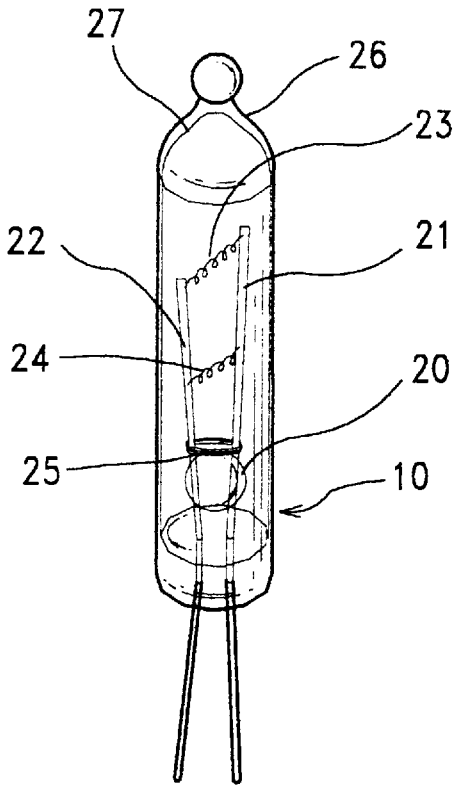
FIG. 3 is a perspective elevational view of a lamp bulb for Christmas tree light according to the present invention.
Figure 4:
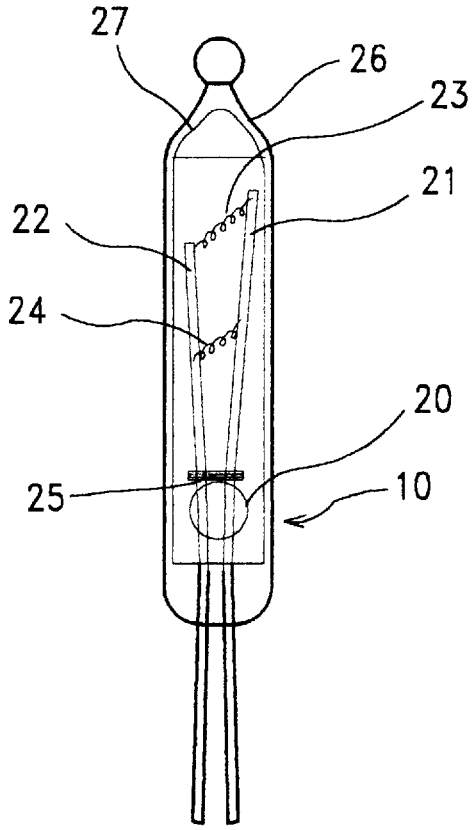
FIG. 4 is a plain view of the lamp bulb shown in FIG. 3.

Referring to FIGS. 3 and 4, a lamp bulb 10 for a Christmas tree light set according to the present invention comprises a mother bulb 26, a daughter bulb 27 inside the mother bulb 26, a first lead-in wire 21, a second lead-in wire 22, a mica disc 25 fastened to the first lead-in wire 21 and the second lead-in wire 22 inside the daughter bulb 27, an exhaust bead 20 fastened to the first lead-in wire 21 and the second lead-in wire 22 inside the daughter bulb 27 and below the mica disc 25, and a first filament 23 connected between the alloy tip of the first lead-in wire 21 and the magnesium-coated tip of the second lead-in wire 22 inside the daughter bulb 27 and spaced from the mica plate 25 at one side opposite to the exhaust bead 20, and a second filament 24 connected between the first lead-in wire 21 and the second lead-in wire 22 and spaced between the first filament 23 and the mica disc 25.

Figure 5:
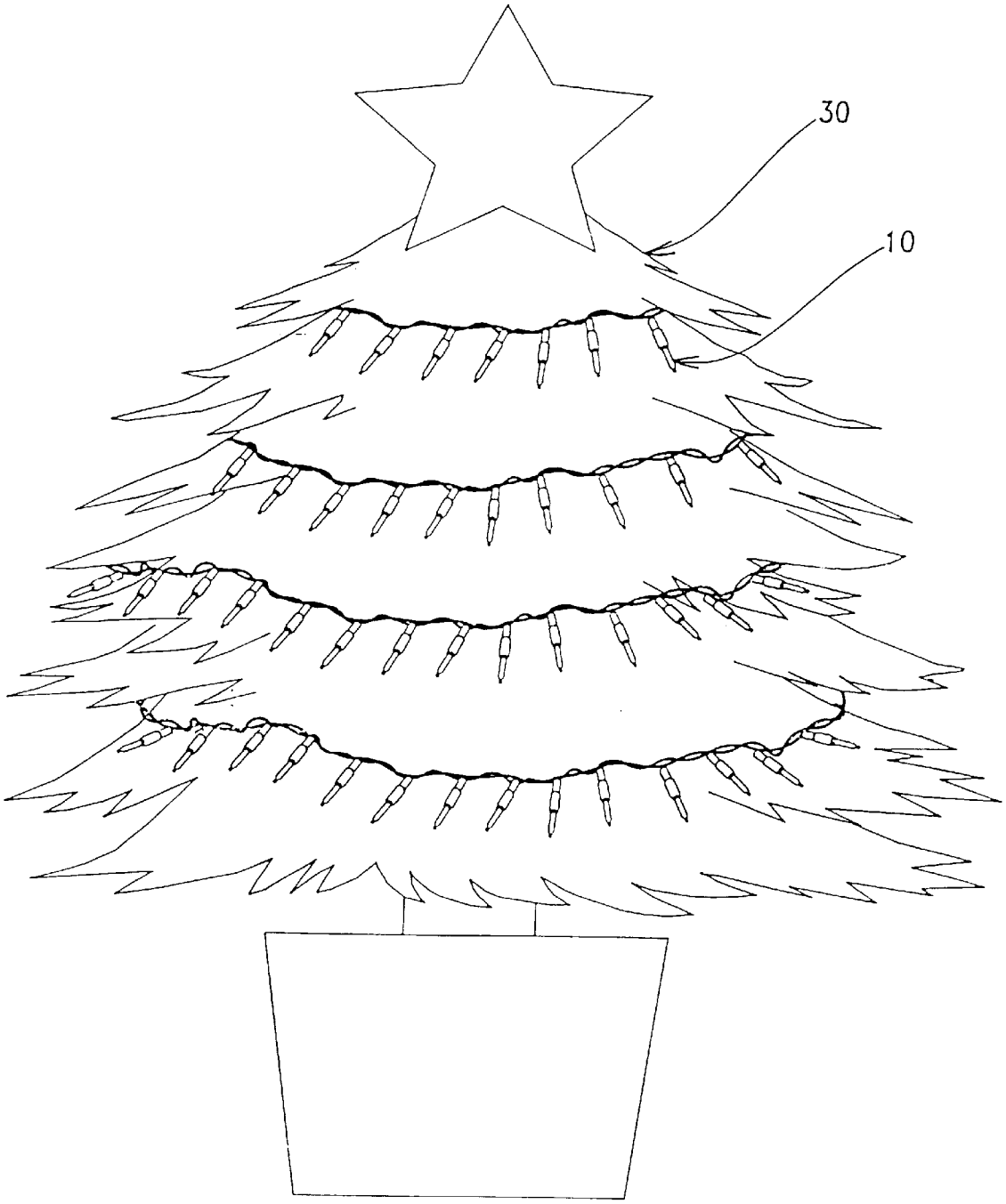
FIG. 5 is an applied view of the present invention, showing an artificial Christmas tree decorated with a Christmas tree light set.

FIG. 5 is an applied view of the present invention, showing an artificial Christmas tree 30 decorated with a Christmas tree light set including a string of lamp bulbs 10.

It is to be understood that the drawings are designed for purposes of illustration only, and are not intended as a definition of the limits and scope of the invention disclosed.

I claim:

1. A lamp bulb for a Christmas tree light, comprising:

a substantially cylindrical elongated bulb body, said bulb body having a receiving end, a tip end and a longitudinal axis extending between said receiving and tip ends, said bulb body including an elongated substantially cylindrical mother bulb and elongated substantially cylindrical daughter bulb disposed within said mother bulb, said mother and daughter bulbs extending along said longitudinal axis of said bulb body;

a pair of lead-in wires extending longitudinally in spaced apart relationship, each of said lead-in wires having an internal part disposed within said bulb body and an external part extending outwardly from said receiving end of said bulb body, said internal part including a tip and an intermediate portion, extending between said tip and said external part;

a mica disk encircling said pair of lead-in wires and disposed within said bulb body in proximity to said receiving end thereof;

an exhaust bead disposed within said bulb body between said mica disk and said receiving end, said pair of lead-in wires protruding through said exhaust bead; and a pair of filaments coupled between said lead-in wires in longitudinally spaced relationship, one of said filaments being coupled between said tips of said lead-in wires and the other of said filaments being coupled between said intermediate portion of said lead-in wires.

* * * * *